US009782618B2

(12) United States Patent
Curry

(10) Patent No.: US 9,782,618 B2
(45) Date of Patent: Oct. 10, 2017

(54) TILTING EXERCISE DEVICE

(76) Inventor: Michael Curry, Marina Del Rey, CA (US)

( * ) Notice: Subject to any disclaimer, the term of this patent is extended or adjusted under 35 U.S.C. 154(b) by 0 days.

(21) Appl. No.: 13/566,546

(22) Filed: Aug. 3, 2012

(65) Prior Publication Data

US 2014/0038797 A1 Feb. 6, 2014

(51) Int. Cl.

| | |
|---|---|
| ***A63B 22/16*** | (2006.01) |
| ***A63B 21/02*** | (2006.01) |
| ***A63B 21/05*** | (2006.01) |
| ***A63B 21/068*** | (2006.01) |
| ***A63B 23/02*** | (2006.01) |
| ***A63B 21/00*** | (2006.01) |
| *A63B 26/00* | (2006.01) |

(52) U.S. Cl.

CPC ..... *A63B 21/023* (2013.01); *A63B 21/05* (2013.01); *A63B 21/068* (2013.01); *A63B 21/4029* (2015.10); *A63B 22/16* (2013.01); *A63B 23/0227* (2013.01); *A63B 23/0238* (2013.01); *A63B 26/003* (2013.01); *A63B 2208/0238* (2013.01); *A63B 2208/0252* (2013.01)

(58) Field of Classification Search

CPC ..... A63B 26/003; A63B 22/16; A63B 21/068; A63B 2208/0204; A63B 2026/00; A63B 2026/003; A63B 2026/006; A63B 22/00; A63B 22/0048; A63B 22/0056; A63B 22/0058; A63B 22/14; A63B 21/023; A63B 21/025; A63B 21/04; A63B 21/0407; A63B 21/0428; A63B 21/05; A63B 21/1457; A63B 21/1461; A63B 21/1465

USPC ..... 482/92, 121, 123, 128, 129–130, 142, 482/146

See application file for complete search history.

(56) References Cited

U.S. PATENT DOCUMENTS

| | | | | |
|---|---|---|---|---|
| 2,996,295 | A * | 8/1961 | Smith | 267/178 |
| 3,024,021 | A | 3/1962 | Coplin, et al. | |
| 3,522,953 | A * | 8/1970 | Gold et al. | 280/21.1 |
| 3,863,915 | A * | 2/1975 | Pifer | 482/51 |
| 4,509,743 | A * | 4/1985 | Lie | 482/71 |
| 5,062,629 | A * | 11/1991 | Vaughan | 482/51 |
| 5,352,176 | A | 10/1994 | Huang | |
| 5,509,871 | A * | 4/1996 | Giovanni | 482/51 |
| 6,413,197 | B2 | 7/2002 | McKechnie et al. | |
| 6,676,579 | B1 * | 1/2004 | Lin | 482/146 |
| 6,695,755 | B1 * | 2/2004 | Huang | 482/146 |
| 7,645,221 | B1 | 1/2010 | Curry | |
| 7,806,807 | B2 | 10/2010 | Genua | |
| 8,105,219 | B1 * | 1/2012 | Sloan et al. | 482/146 |
| 8,343,022 | B1 * | 1/2013 | Sloan et al. | 482/146 |
| 2003/0045410 | A1 | 3/2003 | Kao | |
| 2003/0109365 | A1 * | 6/2003 | Smith | 482/146 |
| 2003/0148853 | A1 * | 8/2003 | Alessandri et al. | 482/5 |
| 2004/0235620 | A1 * | 11/2004 | Barbafieri et al. | 482/31 |
| 2005/0164836 | A1 * | 7/2005 | Harker et al. | 482/52 |
| 2005/0170939 | A1 * | 8/2005 | Lin | 482/148 |
| 2006/0281602 | A1 * | 12/2006 | Dalen | 482/1 |

(Continued)

*Primary Examiner* — Andrew S Lo

(74) *Attorney, Agent, or Firm* — Robert Lauson; Lauson & Tarver LLP

(57) ABSTRACT

A device that exercises the muscles of a person who lays down on a bench (12), by the person shifting his body to counteract a tendency of the bench to tilt to one side or the other. The bench is supported on coil springs (44) that tilt when the person's weight shifts to one side as the person performs exercises while laying on the bench.

6 Claims, 2 Drawing Sheets

(56) References Cited

U.S. PATENT DOCUMENTS

| | | | | |
|---|---|---|---|---|
| 2007/0027009 | A1* | 2/2007 | Arnold | 482/146 |
| 2007/0117697 | A1* | 5/2007 | Genua | 482/146 |
| 2007/0184940 | A1 | 8/2007 | Tomes | |
| 2008/0280741 | A1* | 11/2008 | Baek | 482/146 |
| 2009/0197746 | A1* | 8/2009 | Splane et al. | 482/121 |
| 2009/0227426 | A1* | 9/2009 | Dubar | 482/34 |
| 2011/0275499 | A1* | 11/2011 | Eschenbach | 482/141 |
| 2011/0281701 | A1* | 11/2011 | Zhang | 482/146 |
| 2012/0058865 | A1* | 3/2012 | Scimone | 482/129 |
| 2013/0123082 | A1* | 5/2013 | Bashraheel | 482/141 |
| 2013/0296147 | A1* | 11/2013 | Cruz | 482/146 |

* cited by examiner

TILTING EXERCISE DEVICE

BACKGROUND OF THE INVENTION

People often exercise while lying on a bench, as by lifting weights with their hands. Such exercise usually does not exercise the person's core muscles. An exercise device that enabled a person lying on a bench, to exercise the person's core muscles would be of value.

My earlier U.S. Pat. No. 7,645,221 describes an exercise device that has a platform supported on coil springs, that encourages a person to exercise by shifting his weight to control platform tilt. However, that device does not provide sufficient exercise for the muscles of the chest.

SUMMARY OF THE INVENTION

In accordance with one embodiment of the invention, applicant provides an exercise device that allows a person who lies down on a bench facing down (prone) or facing up (reclined), and who exercises by lifting weights, to exercise his/her chest and related muscles. The bench is an elongated platform with a horizontal upper surface of a sufficient length (e.g. 4 to 5 feet) to support the person in the horizontal position. The bench is supported on springs such as coil springs and is free to tilt. When the person moves, as to repeatedly lift and lower weights, he tends to shift weight laterally and the bench tends to tilt to one side or the other. The person tries to return the bench upper surface to the horizontal by shifting his weight, and in so doing exercises his chest and other abdominal muscles, for better balance and stabilization.

The novel features of the invention are set forth with particularity in the appended claims. The invention will be best understood from the following description when read in conjunction with the accompanying drawings.

DESCRIPTION OF THE INVENTION

Figure 1:
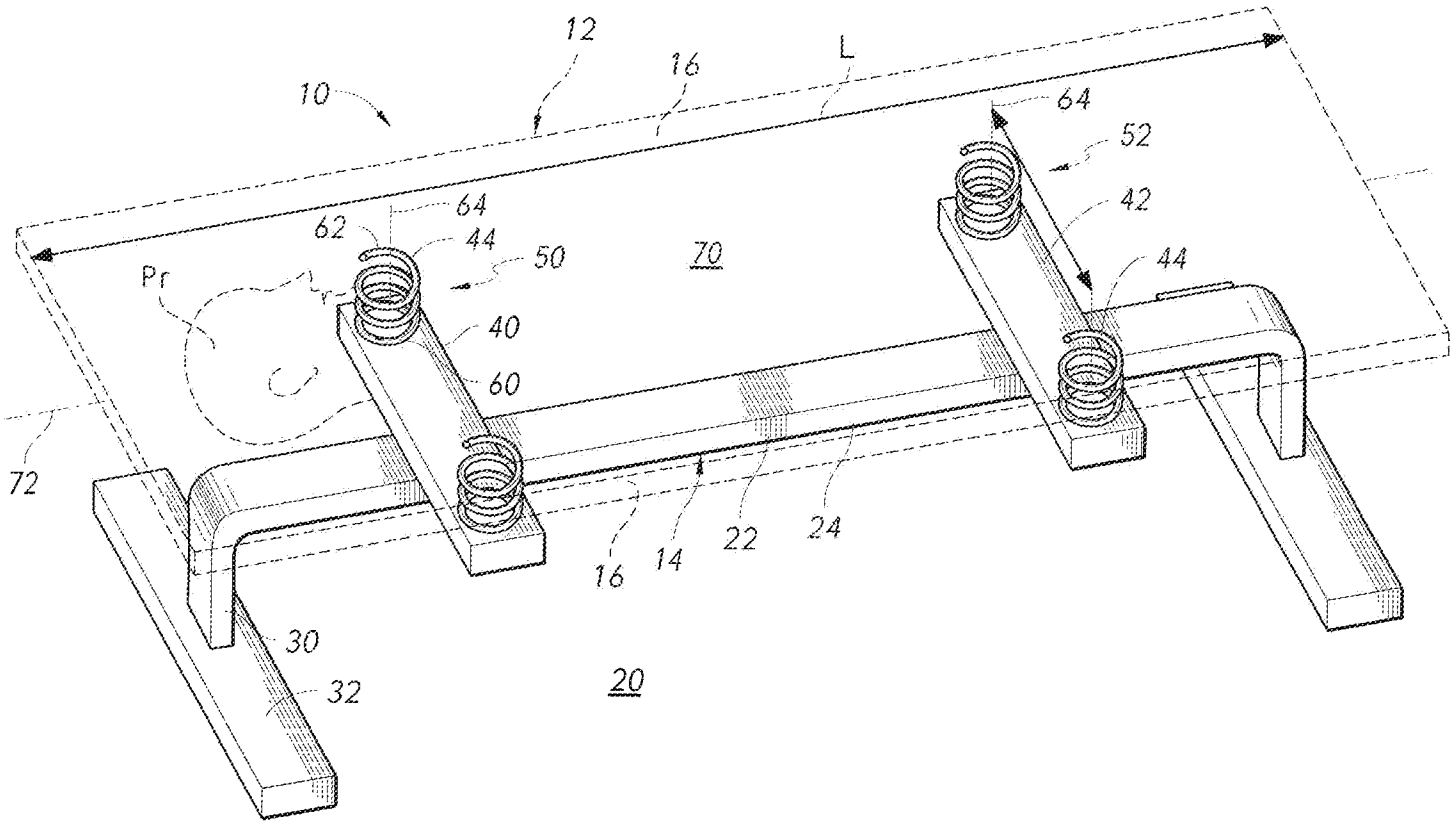
FIG. 1 is an isometric view of a tilting exercise device, with the bench and a person on the bench, shown in phantom lines.

FIG. 1 shows an exercise device 10 of the invention, which includes a bench 12 with an upper surface 70 that is primarily (±10°) horizontal and with laterally opposite sides 16. The bench is designed to receive a person in a reclined position Pr (face up) or a prone position Pp (face down, not shown in FIG. 1). The bench has a length L that is preferably 4 to 5 feet to support three-quarters of body length (hips to head) of the person. The bench is supported by a base 14 that is, in turn, supported on a floor surface 20 (e.g. a wooden, concrete, or even dirt floor). The bench 12 is shown in phantom lines so that the construction of the base 14 can be seen.

The base 14 includes a rigid frame 22 that includes an elongated beam 24 with downwardly projecting ends 30 and a pair of floor-supported beams 32 at the opposite ends. The frame also includes a pair of cross beams 40, 42 that are supported on the elongated beam 24. The device includes four springs 44 arranged in two pairs 50, 52. Each spring 44 has a lower spring end 60 supported on one of the cross beams 40, 42 and an upper spring end 62 attached to the bench 12. Each spring is a coil spring with a primarily vertical axis 64. The springs are arranged so they support the bench with its upper surface 70 being free of tilt from the horizontal, when no torque is applied to the bench that would tilt it about a horizontal length axis 72. However, the springs are also arranged so a small torque can tilt the bench about the axis 72.

Figure 2:
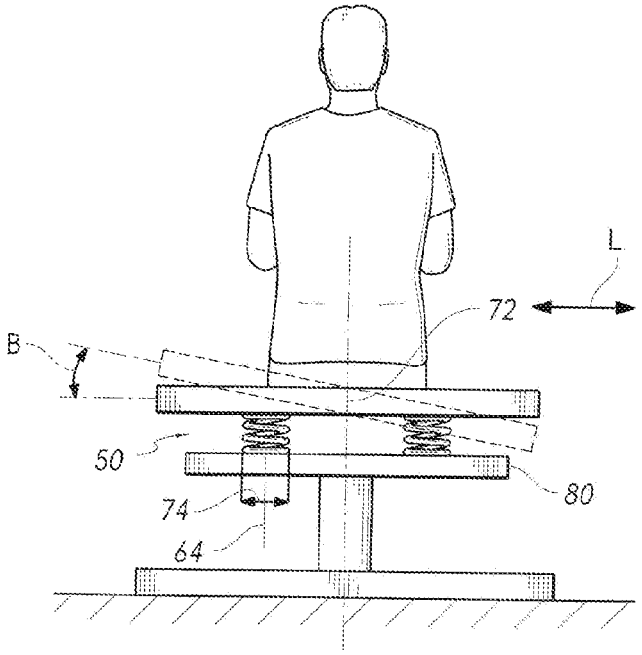
FIG. 2 is a rear elevation view of the device of FIG. 1, showing a person sitting on the bench.
Figure 3:
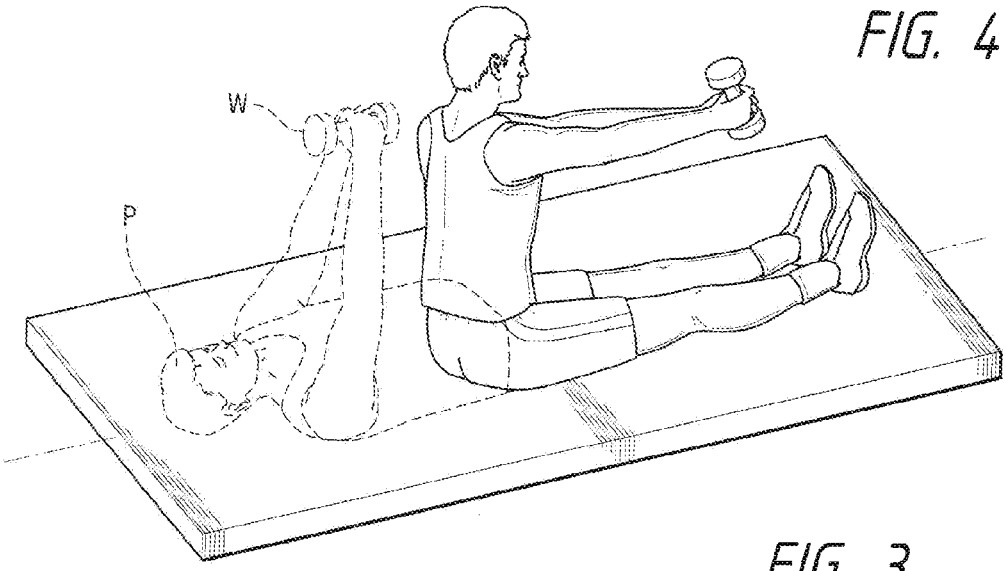
FIG. 3 is an isometric view of the device of FIG. 1, with the person shown in phantom lines in a horizontal position and in a sitting position.

FIG. 2 shows that the angle B that the bench will tilt is determined by the bench resistance to tilt and the torque applied to the bench. The bench resistance to tilt decreases if the springs of a pair such as 50 are moved closer together, if the springs are taller, or if the springs have a smaller diameter 74. FIG. 3 shows a person P moving weights W up and down. Such movement usually results in shifting some weight sidewards, which causes the bench to tilt.

Applicant prefers to provide stops 80 that limit tilt of the bench to an angle such as 30° from the horizontal. The bench should tilt by a plurality of degrees from the horizontal when a person of a weight of 140 to 200 pounds has shifted laterally L by more than one inch from a center location at which the bench upper surface is horizontal.

Figure 4:
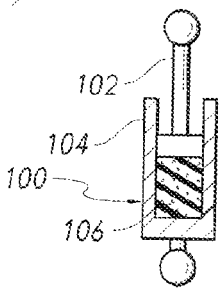
FIG. 4 is a sectional view of another construction of spring.

Although a coil spring is a simple spring to use, it is also possible to use a spring 100 (FIG. 4) formed by a piston 102, a cylinder 104, and a quantity 106 of elastic material (solid or gas) in the cylinder.

Applicant has designed an exercise device of the construction shown in FIGS. 1-3. The coil springs were each formed of steel wire of one-eighth inch diameter wound into coils of 2 inches outside diameter and 3 inches height. The two coils of each pair were spaced apart by 8 inches and were each spaced from the axis 72 by 3 inches.

Thus, the invention provides an exercise device that encourages exercising the muscles at the core and front of a person's torso (chest), especially when the person is performing weight-lifting exercises while lying on a bench. The device includes a bench for supporting the person lying in a horizontal position and with his face up (reclined) or face down (prone), a base that is supported on a floor, and means for supporting the bench on the base. The means for supporting produces noticeable (a plurality of degrees) tilt of the bench axis 72 when a torque of thirty-three foot-pounds has been applied (the center of a person weighing 200 pounds is spaced more than 2 inches from the bench axis).

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An exercise device comprising:

a bench with a bench upper surface (70) for supporting a person, said bench having laterally opposite sides (16) each extending longitudinally between opposite ends, the ends being spaced longitudinally apart by more than a lateral spacing of said sides;

a base constructed to be supported on a primarily horizontal floor surface (20), the base including a frame coupled to the bench by a plurality of resilient members, the frame having:

a first beam extending longitudinally underneath the bench; and a second beam extending underneath the bench transversely across the first beam, each of the resilient members having a lower end secured to the second beam and vertically offset relative to a top surface of the first beam;

the bench upper surface resiliently biased to a horizontal plane, and being displaceable by the weight of the person on said bench upper surface shifting laterally by a plurality of inches to cause the upper surface to resiliently tilt by a plurality of degrees from said horizontal plane.

2. The device described in claim 1 wherein:

said bench has a front-to-rear horizontal centerline (72) and said bench is constructed to support a person who lies on said bench above said centerline and whose body extends parallel to said centerline; and, said frame and resilient members are constructed to allow said bench to tilt by a plurality of degrees about said horizontal centerline when a torque of twenty-three foot pounds is applied to said bench to tilt the bench about said centerline.

3. The device described in claim 1 wherein:

said bench laterally opposite sides (16) are horizontally spaced in a direction perpendicular to the length of a centerline (72);

said resilient members include a plurality of coil springs (44) that each include a wire wound into primarily a helix that has a primarily vertical coil axis (64), said coil springs each having a lower end (60) supported on a cross frame and an upper end (62) that supports said bench;

said bench is stiff and said plurality of coils includes a pair of laterally spaced front coil springs (50) and a pair of laterally spaced rear coil springs (52), said rear springs lying rearward of said front springs.

4. The device described in claim 1 wherein: said frame and resilient members are constructed to allow said bench to tilt about a centerline (72) by at least 30°.

5. An exercise device comprising:

a bench (12) that has an upper surface (70) elongated along a centerline (72), and a length along said centerline of at least 4 feet;

a base that is constructed to be supported against tilt, on a floor surface (20), the base including a frame having:

a first beam extending longitudinally underneath the bench; and, a second beam extending underneath the bench transversely across the first beam;

a plurality of coil springs (44) each having a lower end (60) secured to the second beam of the base and supported to remain vertically offset relative to a top surface of the first beam of said base and an upper end (62) that supports a location on said bench, said bench being free to tilt about said centerline.

6. The exercise device described in claim 5 wherein: said coil springs includes a pair of coil springs with vertical axes that are laterally spaced by between one-half foot and one and one-half feet.

* * * * *